US006720555B2

(12) United States Patent
O'Connor

(10) Patent No.: US 6,720,555 B2
(45) Date of Patent: Apr. 13, 2004

(54) APPARATUS AND METHOD FOR ION CYCLOTRON RESONANCE MASS SPECTROMETRY

(75) Inventor: Peter B. O'Connor, Hyde Park, MA (US)

(73) Assignee: Trustees of Boston University, Boston, MA (US)

( * ) Notice: Subject to any disclaimer, the term of this patent is extended or adjusted under 35 U.S.C. 154(b) by 0 days.

(21) Appl. No.: 10/338,423

(22) Filed: Jan. 8, 2003

(65) Prior Publication Data

US 2003/0127592 A1 Jul. 10, 2003

Related U.S. Application Data

(60) Provisional application No. 60/347,043, filed on Jan. 9, 2002.

(51) Int. Cl.[7] ..... H01J 49/40
(52) U.S. Cl. ..... 250/291
(58) Field of Search ..... 250/291, 292, 250/290

(56) References Cited

U.S. PATENT DOCUMENTS 3,937,955 A 2/1976 Comisarow et al.
4,535,235 A 8/1985 McIver, Jr.
4,686,365 A 8/1987 Meek et al.
5,640,010 A * 6/1997 Twerenbold ..... 250/281
5,848,532 A 12/1998 Gamble et al.
6,177,668 B1 1/2001 Hager

OTHER PUBLICATIONS

Amster: "Fourier Transform Mass Spectrometry," *Journal of Mass Spectrometry*, vol. 31, 1325–1327 (1996).
Marshall: "Milestones in Fourier transform ion cyclotron resonance mass spectrometry technique development," *International Journal of Mass Spectrometry*,200:331 (2000).

(List continued on next page.)

*Primary Examiner*—Kiet T. Nguyen
(74) *Attorney, Agent, or Firm*—Leydig, Voit & Mayer, Ltd.

(57) ABSTRACT

An apparatus and method for performing ion mass spectrometry via Fourier transform ion cyclotron resonance utilizes a superconducting magnet with a bore and a vacuum chamber received in the magnet bore. The superconducting magnet and the vacuum chamber are enclosed in a cooling chamber and cooled together until the operating temperature of the magnet is reached. Because the temperature of the vacuum chamber is similar to the operating temperature of the superconducting magnet during operation, the wall of the vacuum chamber is sufficiently cold to function as a cryogenic vacuum pump to provide enhanced pumping of the volume in the vacuum chamber. The approach of cooling the vacuum chamber wall to provide cryogenic pumping can also be used when the magnet is of a non-superconducting type.

18 Claims, 6 Drawing Sheets

OTHER PUBLICATIONS

Lorenz et al.: "Electrospray Ionization Fourier Transform Mass Spectrometry of Macromolecules: The First Decade," *Applied Spectroscopy*, 53, Number 1:18A (1999).

Marshall et al.: "Fourier transform ion cyclotron resonance detection: principles and experimental configurations," *International Journal of Mass Spectrometry*, 215:59 (2002).

Winger et al.: "High–Resolution Accurate Mass Measurements of Biomolecules Using a New Electrospray Ionization Ion Cyclotron Resonance Mass Spectrometer," *American Society for Mass Spectrometry*, 1044–03505/93:566 (1993).

Schneider et al.: "Confinement in a cryogenic penning trap of highest charge state ions from EBIT," *Rev. Sci. Instrum.*65, No. 11:3472 (1994), retrieved from http://oip-s.aip.org/rscir.jsp Aug. 29, 2002.

Gabrielse et al.: "Cooling and Slowing of Trapped Antiprotons below 100 meV," *Physical Review Letters,*63, Number 13:13–60 (Sep. 25, 1989).

Amster: "Fourier Transform Mass Spectrometry," Journal of Mass Spectrometry, vol. 31, 1325–1327 (1996).

* cited by examiner

APPARATUS AND METHOD FOR ION CYCLOTRON RESONANCE MASS SPECTROMETRY

FIELD OF THE INVENTION

This invention relates generally to mass spectrometry and more particularly to an apparatus and method for ion mass spectrometry that detects ions via ion cyclotron resonance.

BACKGROUND OF THE INVENTION

Fourier transform ion cyclotron resonance mass spectrometry (FTICRMS or FTMS) is a generally known instrumental method that offers higher mass resolution, greater mass resolving power, and higher mass accuracy than other currently available mass analysis methods. The principles of the FTICRMS are well described in several recent review articles and the articles referenced therein. These review articles include: A. Marshall, *Milestones in Fourier Transform Ion Cyclotron Resonance Mass Spectrometry Technique Development*, International Journal of Mass Spectrometry, Volume 200, 2000, pp. 331–356; Amster, I. J., *Fourier Transform Mass Spectrometry*, J. Mass Spectro. 1996, 31, 1325–1337; A. Sarah, E. Lorenz, P. Maziarz III, and T. Wood, *Electrospray Ionization Fourier Transform Mass Spectrometry of Macromolecules: The First Decade*, Applied Spectroscopy, Volume 53, No. 1, 1999, pp. 18A–36A, and A. Marshall and C. Hendrickson, *Fourier Transform Ion Cyclotron Resonance Detection: Principles and Experimental Configurations*, International Journal of Mass Spectrometry, Volume 215, 2002, pp. 59–75.

The performance of the FTICRMS is achieved through the combination of electric and magnetic fields, and is based upon the principle of ion cyclotron resonance (ICR). See, Lawrence, E. O.; Livingston, M. S., *The cyclotron*, Phys. Rev. 1932, 40, 19. Ions in the presence of a uniform static magnetic field are constrained to move in circular orbits in the plane perpendicular to the magnetic field and are unrestricted in its motion parallel to the field. The radius of this circular motion is dependent on the momentum of the ions in the plane perpendicular to the magnetic field. The frequency of the circular motion (cyclotron frequency) is a function of the mass-to-charge ratio of the ion and the magnetic field strength. Furthermore, trapping electrodes provide a static electric field, which prevent the ions from escaping along the magnetic field line. The ions are confined within the trap and as long as the vacuum is substantially high (typically $<10^{-9}$ mbar), ion/neutral collisions are minimized and the ion trapping duration is maximized. Under such conditions, ions can be contained for a long period of time, which in a general mass spectrometry experiment is typically on the order of several seconds.

When the ions are initially trapped, they have an initial low amplitude cyclotron radius defined by their thermal velocity distribution and their initial radial positions. This low amplitude motion is of random initial phase, a state called "incoherent" oscillatory motion. While these ions are trapped, an oscillating electric field can be applied perpendicular to the magnetic field causing those ions having a cyclotron frequency equal to the frequency of the oscillating electric field to resonate. The resonant ions absorb energy from the oscillating electric field, accelerate, gain kinetic energy and move to a higher orbital radii. This process, termed "ion excitation", adds a large amplitude coherent cyclotron motion on top of the low initial thermal amplitude incoherent cyclotron. The net effect is that ions of a given cyclotron frequency, and hence mass, orbit as a packet. When the applied excitation field is switched off, the ions stop absorbing energy and the packet then orbits the chamber at the fundamental cyclotron frequency of the ions that make up this packet. The ion packet produces a signal by inducing onto nearby electrodes an image potential that oscillates at the same cyclotron frequency. This signal induced on the electrode can be amplified, detected, digitized, and stored in computer memory. The signal is typically in the form of a damped sine wave function with the characteristic frequency as described above. As long as the magnetic field in which ions are confined is relatively homogeneous, frequency can be measured very accurately and consequently, the mass-to-charge ratio can be measured with high accuracy.

U.S. Pat. No. 3,937,955, entitled "Fourier Transform Ion Cyclotron Resonance Spectroscopy Method and Apparatus", teaches a method of detecting the signal with a broadband amplifier and subsequently performing a Fourier transformation of the signal to provide a complete mass spectrum. This technique allows for acquiring and detecting all ions simultaneously and with very high mass accuracy.

U.S. Pat. No. 4,535,235, entitled "Apparatus and method for injection of ions into an ion cyclotron resonance cell", teaches that ions generated external of the magnet field can be injected into the ICR cell for analysis. Accordingly, prior to injecting the ions into the ICR, the ions are transmitted along an ion guide, subjected to electric fields for various functions such as mass selection and energy damping. While the ions are trapped within the ICR cell, other techniques are performed to enhance trapping and fragmentation.

It is generally known that virtually every aspect of FTICRMS performance improves at higher magnetic field. For example, if one compares a 14 Tesla magnet to the 7 Tesla instruments that are currently widely available, resolution and signal intensity will triple, mass accuracy will improve by a factor of 2, collisionally activated dissociation (CAD) fragmentation energy will increase by a factor of 4, upper m/z limit will increase by a factor of 4.

High field magnets of the type used in FTICRMS are generally electromagnets and, more specifically, due to the field strength, stability and homogeneity advantages of modern superconducting materials, they are superconducting electromagnets. Currently available superconducting magnet materials must be maintained at low temperature (variable, but typically <10K) to retain their superconductivity. Therefore, these magnets are usually cooled by immersion in liquid helium (~4.2K). Due to the relatively high cost of liquid helium, this immersion vessel, called a Dewar, is then subsequently immersed in liquid nitrogen (which is much less expensive) to decrease the helium boil-off rate. New methods of cryorefrigeration as taught by U.S. Pat. No. 5,848,532, have recently been applied to greatly decrease the boil-off of liquid nitrogen and helium cryogens, and some companies now offer superconducting magnet systems that are completely cryogen free.

Applying superconducting electromagnets to the FTICRMS experiment results in some compromises between the ideal superconducting electromagnet design and the ideal FTICRMS experiment. In general, the narrower the bore size of the magnet, the easier it is to generate higher magnetic fields with sufficient homogeneity and stability for FTICRMS. However, a narrow magnet bore diameter also means that the vacuum chamber that housed the FTICRMS experiment must also be narrow thus restricting the pumping speed of the system. Typical FTICRMS vacuum chambers currently used are in the range of 100 to 150 mm representing a tradeoff between the mutually exclusive goals of achieving high magnetic field and high vacuum simultaneously with current FTICRMS designs. If one were to design a higher magnetic field system with a bore diameter sufficient to accommodated the above-indicated vacuum chamber, and with the required magnetic field homogeneity (typically <10 ppm over a 5 cm diameter by 5 cm long cylindrical region), the magnet will require a larger number of windings and larger size magnets (and larger Dewar). This translates into a higher system cost and larger footprint. Since both lab space and funding are shrinking commodities, this approach, while workable, is undesirable.

Another approach of providing higher magnetic field is a reduction to the bore diameter while maintaining the number of windings and magnet size. The magnets used throughout the NMR field provide 0.1 ppm homogeneity over a 1 cm spherical volume (which is more than sufficient for FTMS), with typically 25 mm–54 mm bore diameter. If one considers installing a high vacuum system into such a diameter, pumping speed immediately becomes a serious problem because of the small throat of the bore tube. For example, a 25 mm internal diameter 0.5 m long vacuum system will have a maximum conductance (in the molecular flow regime) of 3.75 l/sec in the ideal case that ion optics, support brackets, or wires are not blocking the flow ($C=12\ D^3/L$ where C is the conductance, D is the diameter and L the length of the vacuum chamber). See, Moore, J. H., Davis, C. C., Coplan, M. A., Building Scientific Apparatus: A Practical Guide to Design and Construction, 2nd ed., Perseus Books Publishing; L. L. C., Perseus, Mass., 1991. Achieving the $<1\times10^{-9}$ mbar pressure regime needed for ions to remain in a high amplitude, coherent cyclotron orbit becomes very difficult with a pumping speed of 3.75 l/sec. This is particularly true when the outgassing of the vacuum chamber walls is taken into consideration or when performing experiments using pulsed collision gas. For a stainless steel vacuum chamber maintaining a base pressure of $1\times10^{-7}$ mbar after one day of pumping without bake-out requires a pumping speed of 0.1 l/sec for every square centimeter of surface area. The 25 mm diameter, 0.5 m long tube has almost 800 $cm^2$ surface area disregarding the added surface area of the cell, ion optics, wires, etc. A minimum pumping speed of 800 l/sec is required. At $1\times10^{-9}$ mbar, the required pumping speed is approximately 2 orders of magnitude higher. A pumping speed of 3.75 l/sec is generally insufficient.

In a paper entitled *High-Resolution Accurate Mass Measurements of Biomolecules Using a New Electrospray Ionization Ion Cyclotron Resonance Mass Spectrometer*, by B. E. Winger, S. A. Hofstadler, J. D. Bruce, H. R. Udseth, and R. D. Smith, Journal of American Society for Mass Spectrometry, Volume 4, 1993, pp. 566–577, a FTICRMS instrument was described with a cryo-panel mounted in the vacuum system for improved pumping speed. This instrument inserted a large surface area cold array (~20 Kelvin) into the room temperature high vacuum chamber inside the FTMS magnet. With this instrument, Winger et. al clearly demonstrated improved pumping speed. However the instrument used a room temperature bore magnet, room temperature vacuum system, and only the panel inside the vacuum system was cooled.

Also, a paper entitled *Confinement in a Cryogenic Penning Trap of Highest Charge State Ions from EBIT*, by D. Schneider, D. A. Church, B. Beinberg, J. Steiger, B. Beck, J. McDonald, E. Magee, and D. Knapp, Rev. Sci. Instrum. 65 (11), November 1994 pages 3472–3478, show the design and the use of a cryogenic electron beam ion trap (EBIT) and cryogenic penning trap (RETRAP). The EBIT's are experimental physics instruments that are widely utilized within the trapped ion physics field. These instruments are designed to trap positive ions inside the electric field generated by high current electron beams that are collimated using a large magnetic field (several Teslas). The primary purpose for these instruments is for atomic spectroscopy measurements. The EBIT trapping mode fragments all molecules and strips the remaining atoms of electrons, for example, even to the point of producing Uranium $92^+$ atomic ions which are bare nuclei without any electrons. Because of this, EBITs are fundamentally limited in analysis of molecules and completely unsuitable for the analysis of intact biomolecules. However, the electron beam can be turned off, and then the positive atomic ions can be transferred to the RETRAP, where single species monitoring experiments are conducted. Ion detection is observed by a tuned circuit capable of measuring only one ions' axial frequency at a given time, making this method unsuitable for mass spectrometry over a broad m/z range. The RETRAP uses a magnetic field generated by liquid helium cooled Helmholtz coils. The Helmholtz coil system consists of two similarly wound layered coils, spaced apart at a distance equal to the radius of the coils. This configuration has the advantage of permitting an optical access port to be mounted between the coils for conducting optical experiments. Schneider et al. suspends the magnet assembly, which includes the Helmholtz coils and the liquid cryogen, within the vacuum chamber. The vacuum chamber, which also contains the ion guide, is further submersed in a liquid nitrogen bath to help maintain the cryostat condition within the trap. This is a brute force method requiring large amounts of liquid cryogen for operation, and minimal attempts to reduce the thermal transfer between the vacuum system and superconducting magnet are evident. Additionally, because the superconducting magnet is integrated with the vacuum system, the normal operation procedures including routine maintenance and service become laborious. Access to the trap or magnet requires venting the vacuum to atmosphere, and to service the trap, the magnet must be discharged and warmed up to prevent ice formation inside the vacuum chamber or the magnet assembly. For fundamental physics research, the high cryogen consumption rate and the extraneous operation effort have been the norm. However, from a commercial approach, this design is not economically attractive.

In fundamental physics research, Penning traps, like the ones used by Schneider et al., are used to trap and detect ions' axial motion and consequently, they are designed to maintain a hyperbolic electric field along the magnetic field axis so that the axial frequency won't shift substantially over the oscillation. In FTICR mass spectrometry instruments, the ICR cell traps ions and are designed to detect the ions' cyclotron motion rather than their axial motion. This function requires radial homogeneity in the electric fields and in the magnetic field.

Some of the Penning trap instruments are cryogenic as described by Winger et al., but efforts to improve magnetic field strength and homogeneity by minimizing bore diameter are not undertaken as there is little need for higher field at the mass range of atomic ions.

There have been several instruments in which a penning trap is held at very low temperatures (<4.2K) have been used for high mass accuracy trapped ion mass measurement. See, G. Gabrielse, X. Fei, L. A. Orozco, R. L. Tjoelker, J. Haas, H. Kalinowsky, T. A. Trainor, and W. Kells, *Cooling and Slowing of Antiprotons below* 100 *meV*, Physics Review Letters, Volume 63, No. 13, 1989, pp. 1360–1363. In this case, the vacuum system and the bore tube of the magnet are generally held at room temperature and, a cryogenically cooled probe, with the penning trap inside, is inserted into room temperature magnet bore tube. Ions are generated by internal electron impact or an external positron source is used to generate ions that are transferred, at high kinetic energy (>1 keV, but typically >1 MeV), through a titanium window (where they lose some kinetic energy), and are trapped in the cell. Ion optics are minimal, and the penning trap is completely enclosed so that the pressure drops to $<1\times10^{-12}$ mbar. Measurement of ion mass is performed using a resonant circuit to improve the accuracy of an already known mass which is not the same as mass spectrometry in which a broad range of masses are interrogated during the measurement.

SUMMARY OF THE INVENTION

In view of the forgoing, the present invention provides an apparatus for ion cyclotron resonance mass spectrometry. The apparatus has a magnet, preferably a superconducting magnet, for generating an ion confinement magnetic field within a bore of the magnet, and a vacuum chamber received inside the bore. The dimension of vacuum chamber is close to the dimension of the magnet bore, and there is preferably minimal or no thermal shielding between the magnet Dewar and the vacuum chamber to prevent thermal exchange between the magnet Dewar and the vacuum chamber. Both the magnet and the vacuum are contained within a cooling chamber such that they can be cryogenically cooled together. This allows the vacuum chamber to be cooled to a temperature close to the operating temperature of the superconducting magnet. The low temperature of the vacuum chamber during operation allows the chamber wall to function as a cryogenic vacuum pump, thereby proving enhanced vacuum in the chamber.

The present invention also provides a method of performing ion cyclotron resonance mass spectrometry. A magnet, preferably a superconducting magnet, is provided for generating an ion confinement magnetic field within a bore of the magnet, and a vacuum chamber is positioned in the bore of the magnet, preferably with minimal thermal shielding to allow heat exchange between the magnet Dewar and the vacuum chamber. Both the magnet and the vacuum chamber are placed within a cooling chamber and cooled together until the superconducting magnet reaches an operating temperature and the vacuum chamber reaches a temperature sufficiently low to provide cryopumping. Ions to be studied are then injected into vacuum chamber within the ion confinement field generated by the magnet and analyzed by means of ion cyclotron resonance.

BRIEF DESCRIPTION OF THE DRAWINGS

While the appended claims set forth the features of the present invention with particularity, the invention, together with its objects and advantages, may be best understood from the following detailed description taken in conjunction with the accompanying drawings, of which:

DETAILED DESCRIPTION OF THE PREFERRED EMBODIMENTS

Figure 1:
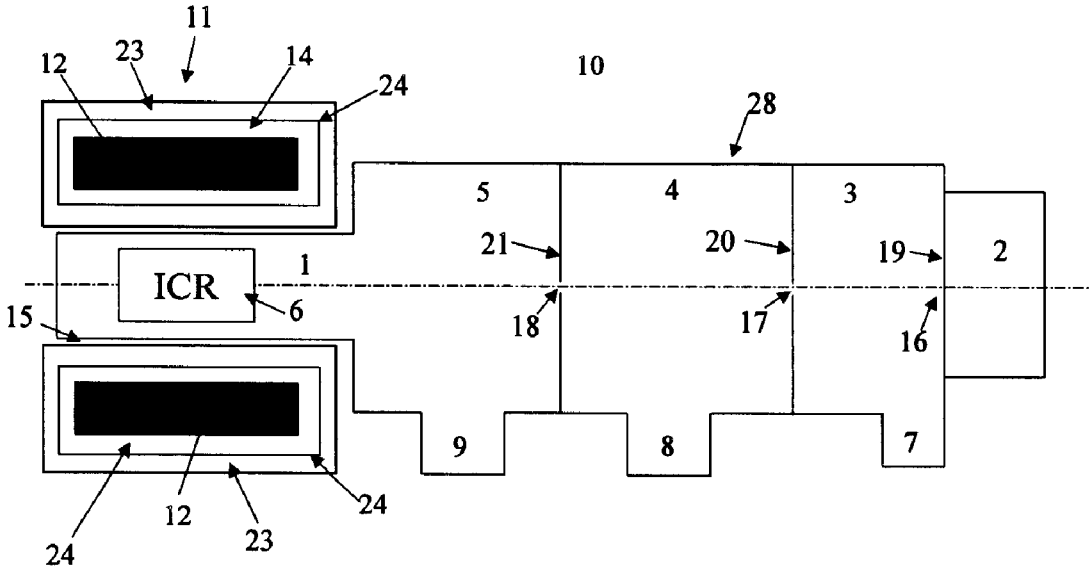
FIG. 1 (PRIOR ART)
FIG. 1 is a schematic view of a prior art FTMS system.

Referring now to the drawings, FIG. 1 shows a conventional prior art FTMS device 10. This device is shown for the purposes of illustrating the problems in conventional FTMS designs, and showing by way of contrast the significant improvements provided by the present invention as described below. The FTMS device 10 includes a conventional ion source 2, which can be one of the many know types of ion sources depending of the type of sample to be analyzed. For instance, the ion source may be an electrospray or ion spray device, a corona discharge needle, a plasma ion source, an electron impact or chemical ionization source, a photo ionization source, or a MALDI source. Other desired types ion sources may be used, and the ion source may create ions at atmospheric pressure, above atmospheric pressure, near atmospheric pressure, or in vacuum.

Ions from the ion source 2 pass into vacuum system 28 consisting of vacuum chambers 3,4 and 5 through apertures 16, 17 and 18, respectively. The pressure in each of the vacuum chambers 3,4 and 5 is step-wise reduced by vacuum pumps 7, 8 and 9, respectively. While three vacuum stages are shown in FIG. 1, more than three stages or less than three stages of vacuum may be used. The apertures 16, 17 and 18 mounted in the partition 19, 20 and 21 between the vacuum stages restrict neutral gas conductance from one pumping stage to the next. The ions move through each vacuum chamber and can be subjected to ion beam focusing, ion selection, ion ejection, ion fragmentation, ion trapping (as shown in U.S. Pat. No. 6,177,668), or any other forms of ion analysis, ion chemistry reaction, ion trapping or ion transmission.

The vacuum chamber 5 is pumped by pump 9 to a pressure between $1\times10^{-6}$ and $1\times10^{-9}$ mbar, preferentially less than $1\times10^{-9}$ mbar. It is generally known that lower base pressure improves performance in FTMS systems. In order to achieve the low pressure, it is necessary to provide a vacuum chamber geometry favorable to high throughput by designing the vacuum chamber 5 with a large cross-sectional area, and to choose a pump 9 with high pumping speed. Pumps 7, 8 or 9 can be of the turbomolecular type or any other known vacuum pump. It is also generally known that baking at least one the vacuum chambers 3, 4 or 5 can allow achievement of lower base pressure.

The ion cyclotron resonance (ICR) cell 6 is located a vacuum chamber region 1 in the vacuum chamber 5 within the bore 15 of the superconducting magnet assembly 11. The ions in vacuum chamber 5 enter the ICR cell 6 and undergo analyses by means of ion cyclotron resonance mass spectrometry. The magnet assembly 11 provides the ion confine magnetic field for the ICR cell 6. The cross-sectional area of vacuum chamber region 1 is sufficiently small to fit in the bore 15.

Figure 2:
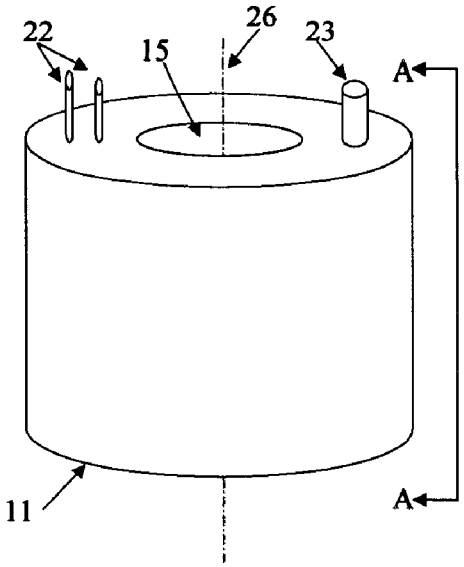
FIG. 2 (PRIOR ART)
FIG. 2 is a perspective view of a typical superconducting magnet assembly of the type shown in FIG. 1.

FIG. 2 shows a typical magnet assembly 11 of the superconducting type, more specifically, of the solenoid type and unlike the Helmholtz coils type, with magnet charging leads 22 and a liquid helium fill port 23. The bore 15 of the magnet assembly is positioned vertically through the center defined by the axis 26. A superconducting magnet in this configuration is known as a vertical bore magnet. Rotating the magnet assembly 11, perpendicular to its axis 26 results in a geometry commonly referred to as a horizontal bore magnet. However, rotating the magnet assembly 11 to any angle other than vertical or horizontal is an acceptable orientation.

Figure 3:
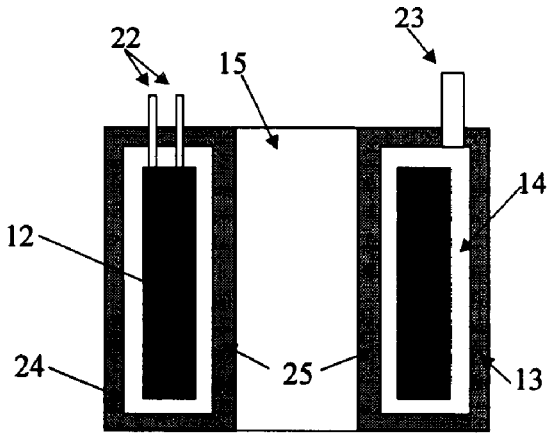
FIG. 3 (PRIOR ART)
FIG. 3 is a cross-sectional view of the superconducting magnet assembly shown in FIG. 2.

FIG. 3 is a cross-section view of FIG. 2 taken along line A—A. The magnet assembly 11 comprises of a cooling chamber 24 commonly referred to as a Dewar. The Dewar 24 houses the magnet coils 12 in a bath of cooling medium 14, such as liquid helium, suitable for cryogenic cooling a superconducting magnet. The Dewar 24 has insulation 13 to provide thermal isolation between the liquid helium 14 and the room-temperature environment. The Dewar 24 has insulation 25 between the bore 15 and the magnet 12. It should be noted that the bore 15 of the magnet assembly is not the same as the bore of the magnet 12, which is larger than the former due to the existence of the shielding 25. The insulation 13 and 25 usually include a liquid-nitrogen-cooled radiation shield and aluminized mylar insulating material. Due to the insulation 25, the bore 15 of the magnet assembly 11 is not cooled with the magnet and is typically maintained at room temperature. It will be seen from FIG. 3 that the dimension of the room temperature bore 15 can be significantly smaller than the bore of the magnet 12 due to the thickness of the insulation 25. As mentioned in the Background Section, this conventional configuration creates a serious problem in pumping the vacuum chamber housing the ICR cell when the bore of the magnet (and the bore 15 of the magnet assembly) is reduced to increase the strength of the confinement field in the ICR cell.

Figure 4:
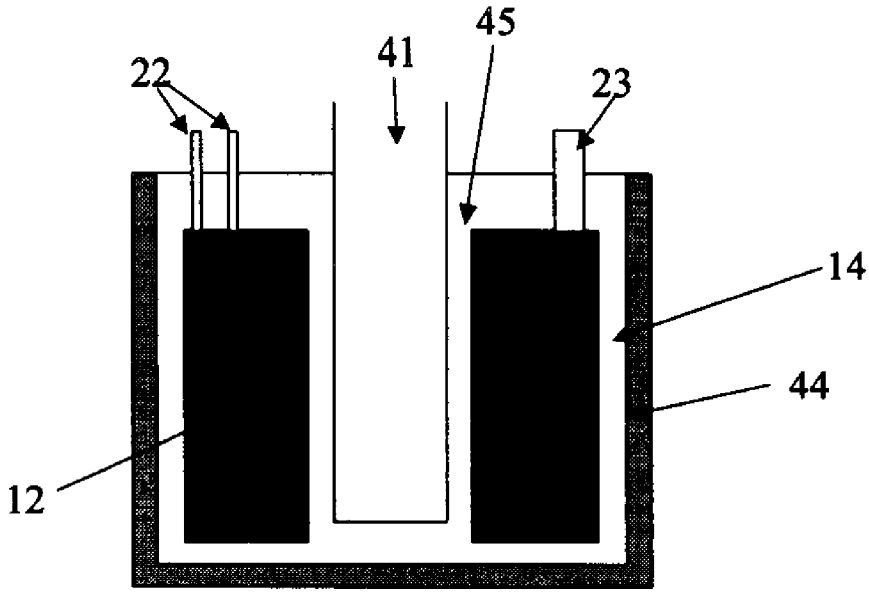
FIG. 4 is a cross-sectional view of a super-conducting magnet and vacuum chamber constructed for use in a cryogenic FTMS device in accordance with the present invention.

In accordance with a feature of the present invention, the undesirable tradeoff between the magnetic field strength and pumping speed is effectively avoided by eliminating or minimizing the need for the insulation or thermal shielding inside the magnet bore, thereby allowing the vacuum chamber housing the ICR cell to be expanded to a dimension close to the dimension of the magnet bore. As a result, a significantly larger vacuum chamber for ICR can be fitted in the bore. As shown in FIG. 4, the Dewar 44 is now a vessel that contains both the superconducting magnet 12 and the vacuum chamber 41 that contains the ICR cell, which is positioned inside the magnet bore 45. This configuration is hereinafter referred to as a "cold bore magnet." In a preferred embodiment, there is minimal or no thermal shielding or insulation between the magnet 12 and the vacuum chamber 41 to prevent heat exchange between the two. It will be appreciated that although superconducting magnets are typically cooled by liquid cryogen such as liquid helium, any other known method of cryorefrigeration, whether cryogen-based or cryogen-free, can be used. Furthermore, the magnet can be of a non-superconducting type capable of achieving the high magnet field required for ion cyclotron resonance measurements.

The cold-bore magnet configuration has at least two potential advantages. First, the available bore diameter for the FTMS device increases without any change in fundamental magnet coil design. This advantage is very important since the cost and difficulty of constructing high-homogeneity high-field magnets increase with the bore size. Second, commercially available vertical bore NMR magnets can be easily modified for use in FTMS devices by removing their room temperature bores. For example, a FTMS instrument with 21 Tesla magnetic field and 0.1 ppm homogeneity could be constructed with the magnets currently commercially available.

Figure 5:
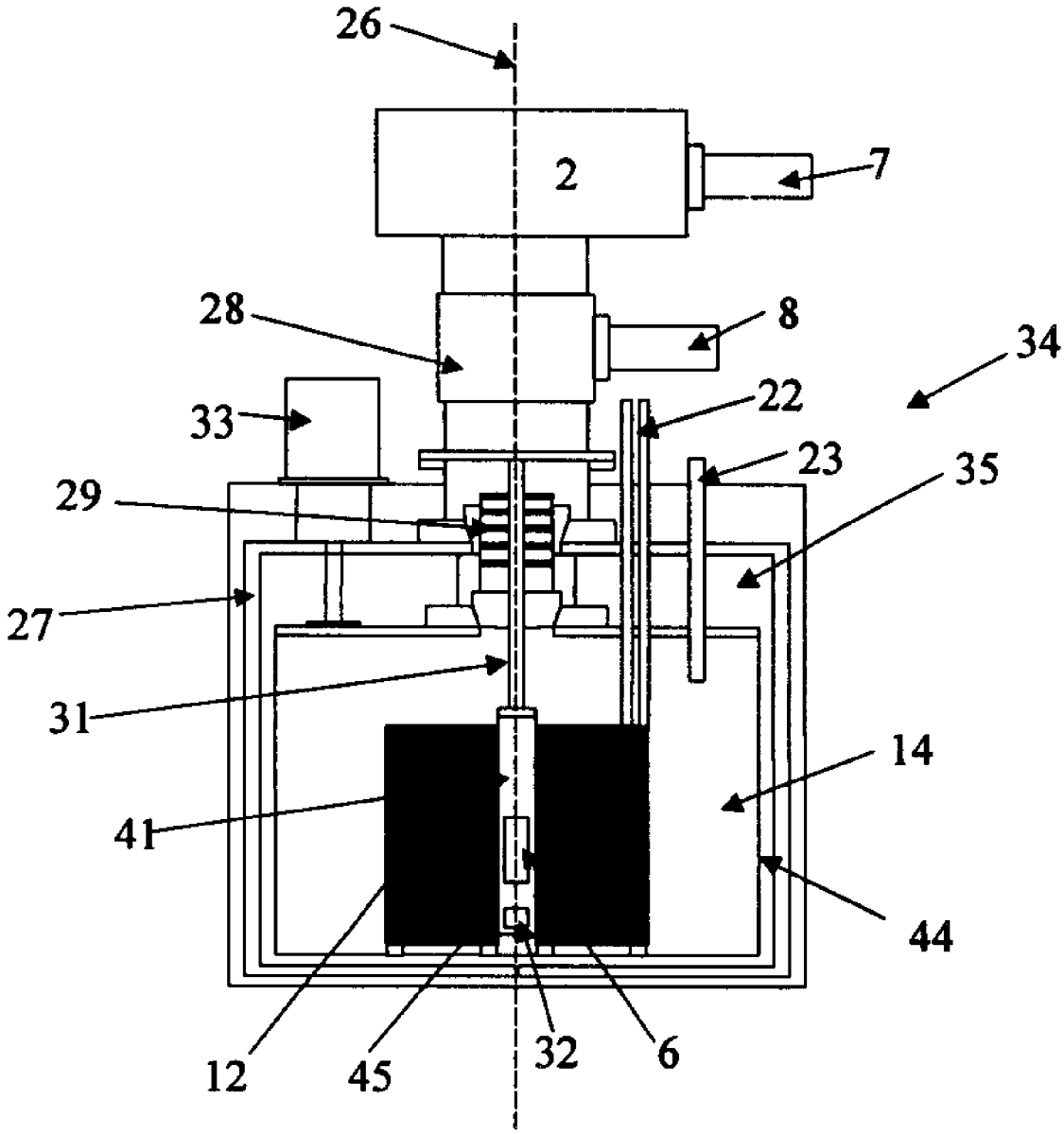
FIG. 5 is a schematic cross-sectional view of an embodiment of a cryogenic FTMS device in accordance with the present invention.

Referring now to FIG. 5, in a preferred embodiment, the vacuum chamber 41 is received in the magnet bore 45 and is in thermal contact with the cooling medium 14 or in direct thermal contact with the magnet 12. As a result, the vacuum chamber 41 is at the same or similar temperature as the magnet 12. In the case of cryogen free superconducting magnets, the thermal contact between the vacuum chamber 41 and the magnet or between the vacuum chamber 41 and the cryorefrigerator will provide the necessary cooling. Any components within the vacuum chamber 41, such as ion guides, mechanical supports, wires, electronics and any other items generally found in a FTMS vacuum system, will be at the same or similar temperature as the vacuum chamber 41, typically below 120 Kelvin.

Since the operating temperature of the superconducting magnet (i.e., the temperature at which the magnet is superconducting) is fairly low, and the magnet and the vacuum chamber 41 is at the same or similar temperature as the magnet 12, the temperature of the vacuum chamber during operation is sufficiently low such that the wall of the vacuum chamber become effectively a cryogenic vacuum pump (or a "cryopump") that can effectively pump gases such as $N_2$, $O_2$, Ar, $H_2$, $CO_2$ and $H_2O$. In this regard, the temperature for effective cryopumping is typically less than 80 Kelvin. It is generally known that cryopumping the vacuum chamber for FTMS would greatly decrease the base pressure in the chamber and increase the total pumping speed of the system.

The approach of cooling the entire vacuum chamber housing the ICR cell to provide cryogenic pumping can be advantageously applied even when the magnet is of a non-superconducting type. In that case, since the magnet does not have to be cooled to a low temperature, it is not necessary to enclose both the magnet and the vacuum chamber in a cooling chamber. In one embodiment, the vacuum chamber is enclosed in a cooling chamber with thermal shielding and cryogenic means for cooling the vacuum chamber, and the cooling chamber fits into the bore of the non-superconducting magnet. During operation, the vacuum chamber is cooled to a cryogenic pumping temperature, while the magnet remains at room temperature. It should be noted that the cryopumping provided by the cooled vacuum chamber 41 can have a higher pumping efficiency than that provided by conventional cryopumping devices and can have other advantages. The art teaches methods of cryopumping in a vacuum chamber wherein cryo-panels, cooled remotely by cryorefrigerator, are installed in the vacuum chamber. To maximize the pumping efficiency of the cryo-panels, the cryo-panels incorporate an array of panels of high surface area, each of which provides cryopumping. Typically, these cryoarrays are large and take up space in the vacuum chamber, impeding the ion guide design of the FTMS system. Furthermore, only the surfaces of the cryo-panels have temperature suitable for cryopumping while the temperature of the vacuum chamber and internal components are at substantially higher temperature where outgassing from their surfaces will occur. In the present invention, the vacuum chamber surface and internal components not only no longer increase the pressure in the chamber by outgassing, but actually become cryopumping surfaces.

In the preferred embodiment illustrated in FIG. 5, a series of mechanical and thermal measures are taken to minimize thermal transfer between the cooling chamber or Dewar 44 and the rest of the system, thereby minimizing cryogen cooling medium boil-off. Generally, immersion of a metal chamber in the liquid helium would increase helium boil-off due to the increased heat transfer into the Dewar 44. If excessive heat transfer or excessive cryogen boil-off causes the magnet temperature to increase above what is necessary for maintenance of superconductivity, quenching and damage to the magnet can occur. In the embodiment of FTMS system 34 shown in FIG. 5, a major source of heat load on the liquid helium is heat conduction down the ion guide tube 31. The Dewar 44 containing the magnet 12 has a portion of the ion guide tube 31 within the cooling medium 14. The remaining section of the ion guide tube 31 has cooling fins 29 mounted detachably to the ion guide tube 31. The conductive heating along the ion guide tube 31 can be controlled by forcing the helium boil-off to go up, pass the cooling fins 29, along the outside of the vacuum system 28 walls to exit at the top of the Dewar 44, next to the ion source 2. The boil-off will cool the ion guide tube 31 and reduce the conductive heat transfer at the cooling fins 29, carrying the heat load up and out of the Dewar 44. The vacuum chamber 41, ion guide tube 31, cooling fins 29 and vacuum system 28 can be designed with low thermal conductivity stainless steel or titanium alloys, ceramics, or glass to decrease the conductive heat load on the cooling system.

Additionally, radiation heat shield 27 connected detachably to the vacuum system 28 provides additional source of thermal isolation between Dewar 44 and room temperature. The region 35 between the Dewar 44 and the heat shield 27 is filled with thermal insulation, generally a vacuum chamber with aluminized mylar thermal isolation material and provides further thermal isolation between the two different temperature surfaces. The region 35 between Dewar 44 and heat shield 27 can also be partially or completely filled with an additional cooling medium such as liquid nitrogen. A two stage cryorefrigerator 33 (or one or more single stage cryorefrigerators) connected to the heat shield 27 and the Dewar 44 can be used to provide additional cooling to further reduce heat transfer and cryogen boil-off. In some cases, this geometry can be used to condense the boil-off from the cooling medium 14 in the cold bore magnet.

Figure 6:
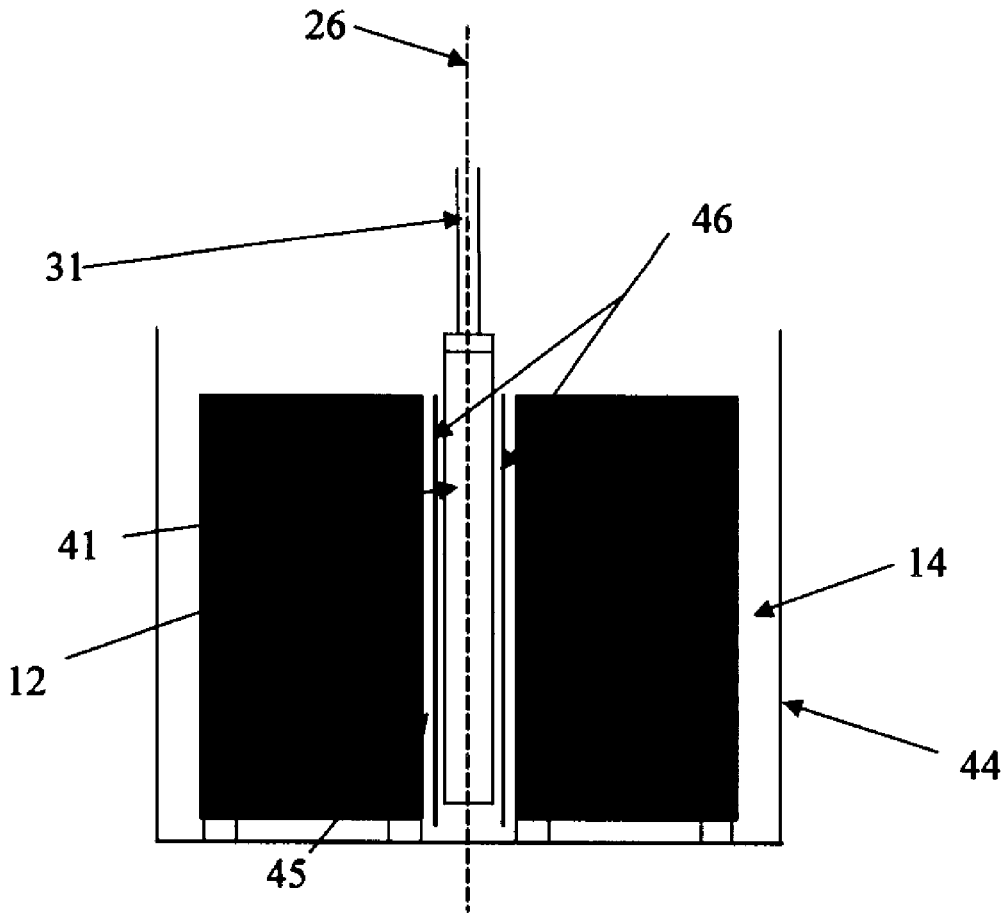
FIG. 6 is a schematic cross-sectional view of a further embodiment as shown in FIG. 5.

Furthermore, in an alternative embodiment, as indicated in FIG. 6, a radiation shield 46 is inserted between the vacuum chamber 41 and the magnet bore 45 to shield the magnet 12 from the possibility of an intermittent elevation in thermal transfer (thermal shock) from the vacuum chamber 41, which could potentially trigger t a magnet quench. The cooling medium 14 remains in contact with the magnet 12 and the vacuum chamber 41, wherein the cooling medium 14 provides the cooling for both elements. The radiation shield 46 or a radiation shield of a similar design, can allow removal or reinsertion of the vacuum system while the magnet is both charged and cold. In the situation where the superconducting magnet is cryogen free as described above, the thermal contact is between the vacuum chamber 41 and the cryorefrigerator. For example, referring to FIG. 7, the magnet 12 is cooled by the cryorefrigerated Dewar 47, and the radiation shield 46 is provided to prevent magnet thermal shock, and the vacuum chamber 41 is in thermal contact 48 with the cryorefrigerated Dewar 47 located beyond the radiation shield 46.

It will be realized from the foregoing disclosure that various methods may be used to establish and maintain a vacuum chamber at the cryopumping temperature, while maintaining the bore and magnet temperature at the level suitable to sustain the high magnetic field. The methods include manipulation of the vacuum chamber 28 to remove the direct line of sight, and hence radiative heating, between the ion source 2 to the vacuum chamber 41, providing additional source of cryorefrigeration for the FTMS system 34, and other methods of which will produce the cryostat environment.

Figure 7:
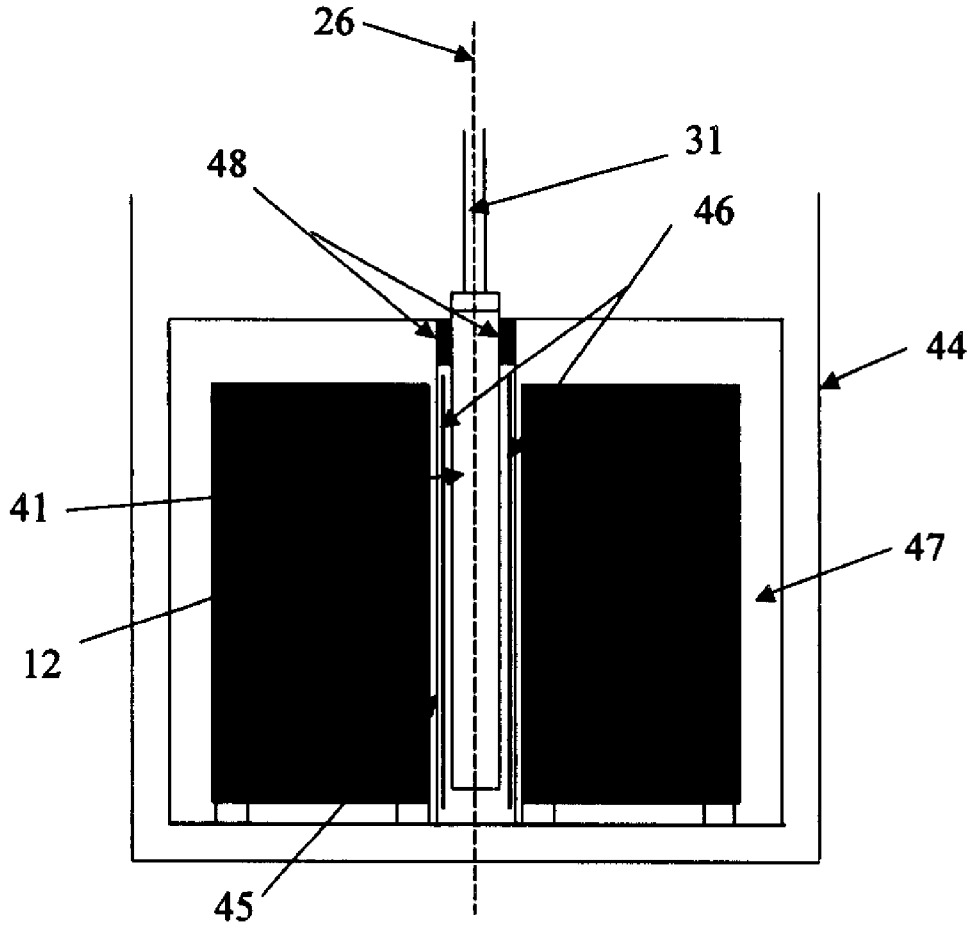
FIG. 7 is a schematic cross-sectional view of a further embodiment as shown in FIG. 6.

The axis 26 as shown in FIGS. 5, 6 and 7 indicates that the magnet 12 has a vertical orientation and more specifically shown in FIG. 5, the ion guide tube 31, the vacuum system 28, and the ion source 2, has axis 26 in a vertical orientation. In general, the axis 26 can deviate from the vertical orientation to have any angle, such that the magnet 12, the ion guide tube 31, the vacuum system 28, and the ion source 2 are positioned at any angle, for example, 0° (horizontal), 45°, 90° (vertical), or any other angle. However, it is not necessary for the magnet 12, the ion guide tube 31, the vacuum system 28, and the ion source 2 to share the same axis as shown in FIG. 5. Each of the elements can be positioned at different angles from the vertical.

In accordance with an aspect of the preferred embodiment, the vacuum chamber 41 containing the ICR cell 6 has signal amplifier 32 that is in thermal contact with the vacuum chamber 41. The heat generated by the signal amplifier 32 flows away from the signal amplifier to the vacuum chamber 41 so as to maintain a reduced temperature. There are several advantages to this method. First, it is generally known that cooling the resistors in the circuit of the preamplifier would greatly improve the performance of the signal amplifier by decreasing the Johnson noise. Second, by providing thermal conductivity between the components of the preamplifier and the cold vacuum system, no additional cooling device, such as a Peltier cooler, is required.

While preferred embodiments of the invention have been described, it will be appreciated that changes may be made within the spirit of the invention and all such changes are intended to be included in the scope of the claims.

What is claimed is:

1. An ion cyclotron resonance mass spectrometer comprising:

a superconducting magnet for generating an ion confinement magnetic field, the superconducting magnet having a bore;

a vacuum chamber having an ion cyclotron resonance region, said vacuum chamber being received inside the bore of the superconducting magnet; and a cooling container enclosing both the superconducting magnet and the vacuum chamber and having means for cooling the superconducting magnet and the vacuum chamber together such that the superconducting magnet reaches an operating temperature and the vacuum chamber reaches a temperature similar to the operating temperature of the superconducting magnet and sufficient for providing cryopumping.

2. An ion cyclotron resonance mass spectrometer as in claim 1, wherein the operating temperature of the superconducting magnet is below 120 Kelvin.

3. An ion cyclotron resonance mass spectrometer as in claim 1, wherein the vacuum chamber is cooled to a temperature lower than 80 Kelvin.

4. An ion cyclotron resonance mass spectrometer as in claim 1, wherein the means for cooling uses a liquid cryogen.

5. An ion cyclotron resonance mass spectrometer as in claim 4, wherein the liquid cryogen is liquid helium.

6. An ion cyclotron resonance mass spectrometer as in claim 1, wherein the means for cooling comprising of a cryogen-free refrigerator.

7. An ion cyclotron resonance mass spectrometer as in claim 1, further comprising a radiation shield disposed between the vacuum chamber and the superconducting magnet bore.

8. An ion cyclotron resonance mass spectrometer as in claim 1, further comprising a signal amplifier inside the vacuum chamber and in direct thermal contact with the vacuum chamber.

9. An ion cyclotron resonance mass spectrometer as in claim 1, wherein the superconducting magnet and vacuum chamber are positioned such that the bore of the magnet is in a vertical position.

10. A method of performing ion cyclotron resonance mass spectrometry measurements, comprising:

providing a superconducting magnet for generating an ion confinement field, a vacuum chamber having an ion cyclotron resonance region, said vacuum chamber being received within a bore of the superconducting magnet, and a cooling chamber enclosing both the superconducting magnet and the vacuum chamber to allow the superconducting magnet and the vacuum chamber to be cooled together;

cooling the superconducting magnet and the vacuum chamber until the superconducting magnet reaches an operating temperature and the vacuum chamber reaches a temperature sufficiently cold for providing cryopumping;

energizing the superconducting magnet to generate an ion confinement field in the ion cyclotron resonance region;

injecting ions to be studied into the ion cyclotron resonance region of the vacuum chamber; and detecting cyclotron resonance signals generated by the ions.

11. A method as in claim 10, wherein the step of cooling cools the superconducting magnet to an operating temperature below 120 Kelvin.

12. A method as in claim 10, wherein the step of cooling cools the vacuum chamber to a temperature below 80 Kelvin.

13. A method as in claim 10, wherein the step of cooling is by means of a liquid cryogen.

14. A method as in claim 13, wherein the liquid cryogen is liquid helium.

15. A method as in claim 10, wherein the step of cooling is by means of a cryogen-free refrigerator.

16. A method as in claim 10, wherein the step of detecting is by means of a signal amplifier placed inside the vacuum chamber and in direct thermal contact with the vacuum chamber.

17. An ion cyclotron resonance mass spectrometer comprising:

a magnet for generating an ion confinement magnetic field within a bore of the magnet;

a vacuum chamber having an ion cyclotron resonance region, said vacuum chamber being received inside the bore of the magnet; and means for cooling the vacuum chamber to a temperature sufficiently cold for a wall of the vacuum chamber to provide cryogenic pumping inside the vacuum chamber.

18. A method of performing ion cyclotron resonance mass spectrometry measurements, comprising:

providing a magnet for generating an ion confinement field and a vacuum chamber having an ion cyclotron resonance region, said vacuum chamber being received within a bore of the magnet;

cooling the vacuum chamber to a temperature sufficiently cold for a wall of the vacuum chamber to provide cryogenic pumping inside the vacuum chamber;

energizing the magnet to generate an ion confinement field in the ion cyclotron resonance region;

injecting ions to be studied into the ion cyclotron resonance region of the vacuum chamber; and detecting cyclotron resonance signals generated by the ions.

* * * * *